US005340674A

United States Patent [19]

Moscony et al.

[11] Patent Number: 5,340,674

[45] Date of Patent: Aug. 23, 1994

[54] METHOD OF ELECTROPHOTOGRAPHICALLY MANUFACTURING A SCREEN ASSEMBLY FOR A CATHODE-RAY TUBE WITH A SUBSEQUENTLY FORMED MATRIX

[75] Inventors: John J. Moscony; George M. Ehemann, Jr., both of Lancaster, Pa.

[73] Assignee: Thomson Consumer Electronics, Inc., Indianapolis, Ind.

[21] Appl. No.: 37,637

[22] Filed: Mar. 19, 1993

[51] Int. Cl.[5] ..... G03C 5/00

[52] U.S. Cl. ..... 430/28; 430/23; 430/29

[58] Field of Search ..... 430/23, 28, 29

[56] References Cited

U.S. PATENT DOCUMENTS

| | | | |
|---|---|---|---|
| 3,489,556 | 1/1970 | Drozd | 96/1 |
| 4,448,866 | 5/1984 | Olieslagers et al. | 430/24 |
| 4,921,767 | 5/1990 | Datta et al. | 430/23 |
| 5,028,501 | 7/1991 | Ritt et al. | 430/23 |
| 5,083,959 | 1/1992 | Datta et al. | 445/52 |
| 5,093,217 | 3/1992 | Datta et al. | 430/28 |
| 5,229,234 | 7/1993 | Riddle et al. | 430/23 |
| 5,240,798 | 8/1993 | Ehemann, Jr. | 430/28 |

*Primary Examiner*—Steve Rosasco

*Attorney, Agent, or Firm*—Joseph S. Tripoli; Dennis H. Irlbeck; Vincent J. Coughlin, Jr.

[57] ABSTRACT

A luminescent screen assembly for a CRT is made by first coating the interior surface of a faceplate panel with a photoconductive layer which overlies a conductive layer. A multiplicity of red-, green- and blue-emitting phosphor screen elements are then deposited in color groups, in a cyclic order, onto the interior surface of the panel. A negative charge is then established on the photoconductive layer. The charge is weakened in the areas where the photoconductive layer underlies the phosphor screen elements, but unaffected in the open areas separating the phosphor screen elements. The charged, open areas of the photoconductive layer are discharged by flood illumination and reversal developed by depositing thereon particles of light-absorptive matrix material having a triboelectric charge of the same polarity as the charge established on the photoconductive layer. The novel process provides a high opacity matrix.

8 Claims, 3 Drawing Sheets

Fig. 1
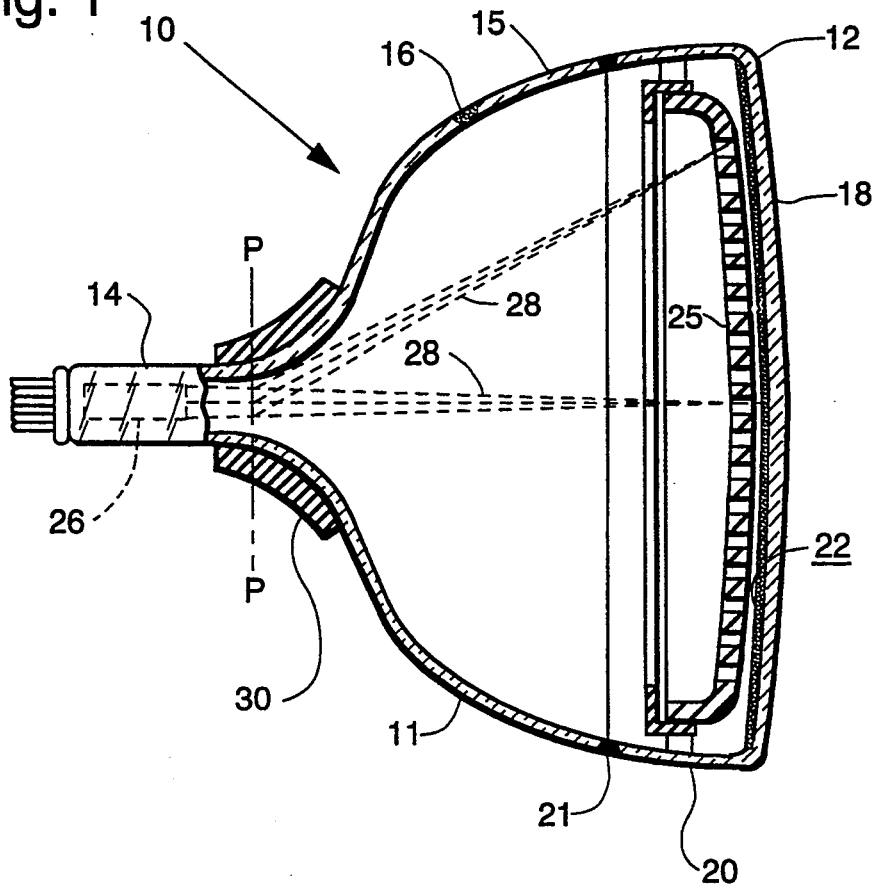
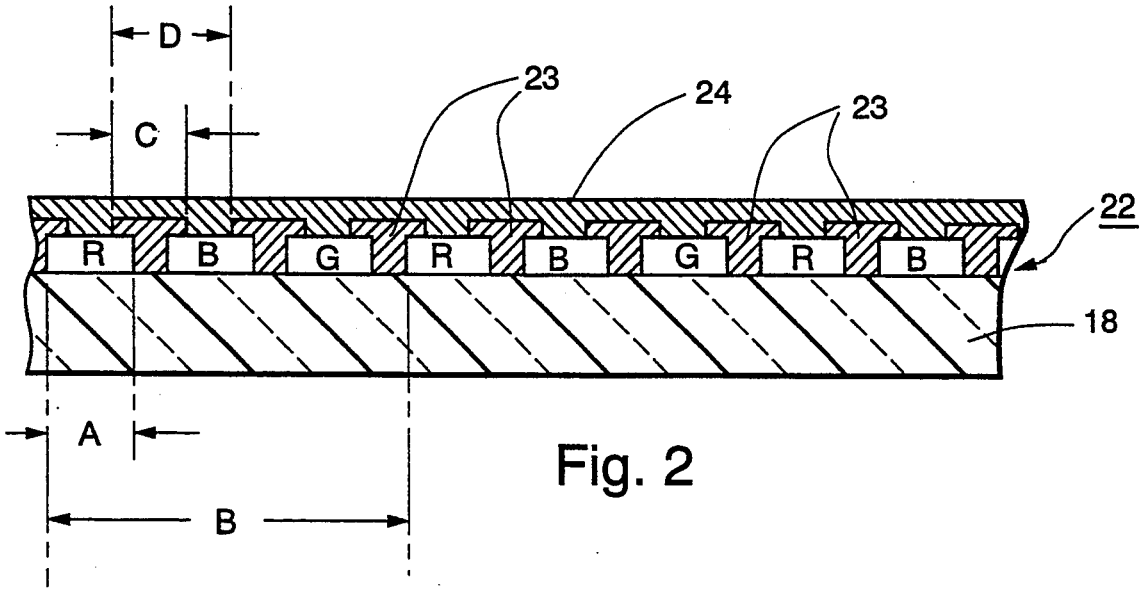
Fig. 2

34
32
18
DEPOSIT
12

36
DC VOLTS
34
32
18
CHARGE 38
40
25
34
32
18
EXPOSE 18
12
32
34
42
PHOSPHOR DEVELOP

36'
DC VOLTS
R
B
G
R
34
32
18
CHARGE 44
46
R
B
G
R
34
32
18
FLOOD EXPOSE 12
18
32
34
R
G
B
42'
MATRIX DEVELOP

METHOD OF ELECTROPHOTOGRAPHICALLY MANUFACTURING A SCREEN ASSEMBLY FOR A CATHODE-RAY TUBE WITH A SUBSEQUENTLY FORMED MATRIX

The present invention relates to a method of electrophotographically manufacturing a screen assembly for a cathode-ray tube (CRT), and, more particularly, to a method of electrophotographically depositing triboelectrically-charged matrix material subsequent to the deposition of phosphor materials.

BACKGROUND OF THE INVENTION

U.S. Pat. No. 4,921,767, issued to Datta et al. on May 1, 1990, describes a method of electrophotographically manufacturing a luminescent screen assembly for a CRT using triboelectrically-charged matrix and phosphor materials. In the patented method, a photoconductive layer, overlying a conductive layer, is electrostatically charged to a positive voltage and exposed, through a shadow mask, to light from a xenon flash lamp, located in a lighthouse. The exposure is repeated a total of three times, from three different lamp positions, to discharge the areas of the photoconductive layer and create an electrostatic image where the light-emitting phosphors subsequently will be deposited to form the screen. The shadow mask is removed, and triboelectrically-(negatively) charged particles of light-absorptive matrix material are directly deposited onto the positively-charged areas of the photoconductive layer which define the matrix openings.

After the matrix is formed, the photoconductor is recharged to a positive voltage and then exposed to light through the shadow mask to discharge the areas where the first of three triboelectrically-(positively)-charged, light-emitting phosphors will be deposited. Prior to phosphor deposition, the shadow mask, again, is removed from the faceplate panel. Then, the first triboelectrically-(positively)charged phosphor is deposited, by reversal development, onto the discharged areas of the photoconductive layer. The process is repeated twice more to deposit the second and third color-emitting phosphor materials.

One drawback of the patented method is the need to insert and remove the shadow mask one additional time to permit the discharge of the photoconductive layer and the deposition of the matrix material in addition to the phosphors. The additional steps add time, as well as equipment and process costs, and increase the probability of damage, either to the screen or to the mask. Another drawback is the difficulty of obtaining sufficient opacity in the deposited matrix. The opacity is proportional to the amount of light-absorptive material that is deposited in the matrix openings. In the electrophotographic screening process, a high opacity matrix requires a high voltage contrast in the patterned electrostatic image formed on the photoconductive layer. In a 51 cm diagonal tube the matrix lines are only about 0.1 to 0.15 mm (4 to 6 mils) wide and have a pitch, or spacing, between adjacent matrix lines of only about 0.28 mm (11 mils), compared to a width of about 0.27 mm and a pitch of about 0.84 mm (33 mils) for phosphor lines of the same emissive color. Thus, the reduced line size and spacing of the matrix lines increase the difficulty of forming images. The combined effects of the extended flash lamp source and the diffraction of the light passing through the slots, or apertures, in the shadow mask, for the three exposures required for the matrix image pattern, produce overlapping penumbras on the photoconductive layer that are not totally black, but which have a light level of about 25% of that found in the highly illuminated areas of the layer. In other words, the exposure through the shadow mask does not produce a light pattern comprising totally illuminated or totally black areas, but instead produces a pattern of light areas separated by gray penumbras of reduced light intensity. Accordingly, the voltage contrast of the patterned electrostatic images formed on the photoconductive layer is much lower for the matrix exposure than for the phosphor exposures, and the resultant matrix lines are less opaque than desired, especially at the edges of the lines. It has been determined that because of the above-described light diffraction pattern through the shadow mask, it is not possible to improve the voltage contrast by increasing the exposure time, since the voltage contrast of the photoconductive layer reaches a maximum and then decreases as the light exposure time increases.

SUMMARY OF THE INVENTION

In an electrophotographic process for manufacturing a luminescent screen assembly on an interior surface of a faceplate panel of a CRT, the panel is first coated with a conductive layer and then overcoated with a photoconductive layer. A multiplicity of red-, green- and blue-emitting phosphor screen elements are deposited in color groups, in a cyclic order, onto the surface of the panel. A charge is established on the photoconductive layer. The charge is weakened in the areas where the photoconductive layer underlies the phosphor screen elements, but unaffected in the open areas separating the phosphor screen elements. The open areas are discharged by illuminating at least these areas with actinic radiation. The open areas of the photoconductive layer are reversal developed by depositing thereon particles of light-absorptive matrix material having a suitable triboelectric charge.

BRIEF DESCRIPTION OF THE DRAWINGS

FIG. 1 is a plan view, partially in axial section, of a color CRT made according to the present invention.

FIG. 2 is a section of a faceplate panel of the CRT of FIG. 1 showing a screen assembly.

DETAILED DESCRIPTION OF THE PREFERRED EMBODIMENT

Figure 3:
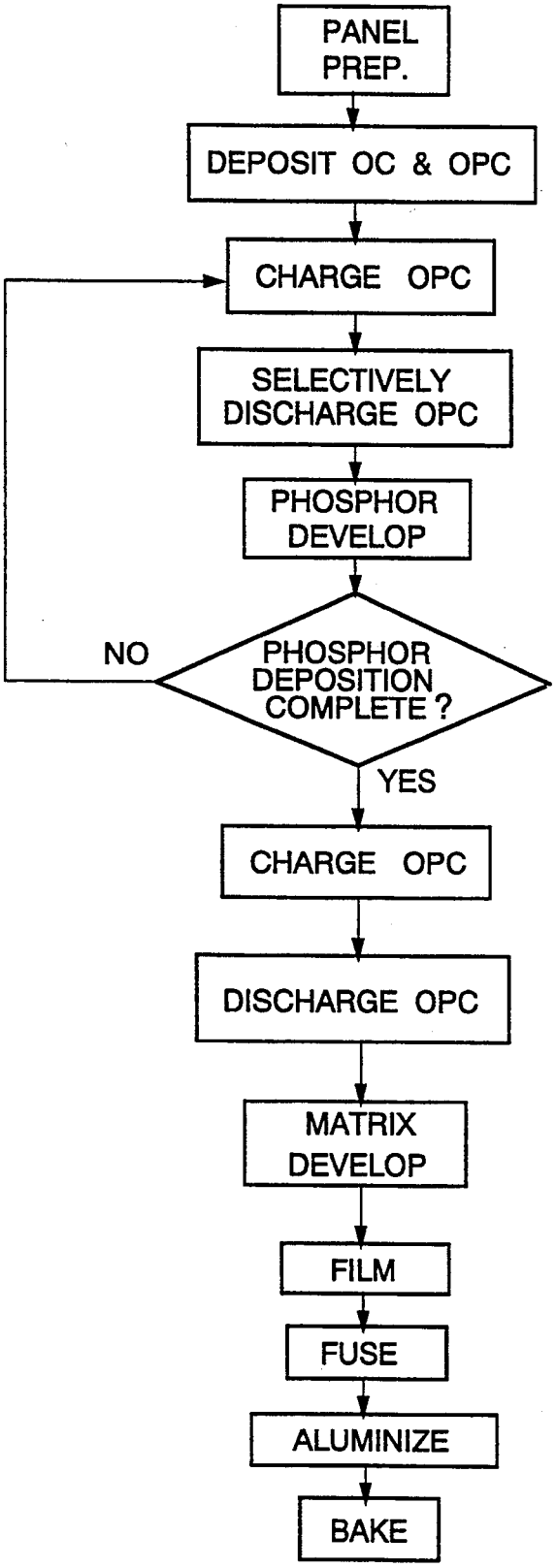
FIG. 3 is a block diagram of the novel manufacturing process for the screen assembly.

FIG. 1 shows a color CRT 10 having a glass envelope 11 comprising a rectangular faceplate panel 12 and a tubular neck 14 connected by a rectangular funnel 15. The funnel 15 has an internal conductive coating (not shown) that contacts an anode button 16 and extends into the neck 14. The panel 12 comprises a viewing faceplate, or substrate, 18 and a peripheral flange, or sidewall, 20 which is sealed to the funnel 15 by a glass frit 21. A three color phosphor screen 22 is carried on the interior surface of the faceplate 18. The screen 22, shown in FIG. 2, preferably is a line screen which includes a multiplicity of screen elements comprised of red-, green- and blue-emitting phosphor stripes, R, G and B, respectively, arranged in color groups, or picture elements, of three stripes, or triads, in a cyclic order, and extending in a direction which is generally normal to the plane in which the electron beams are generated. Typically, for a 51 cm diagonal tube, each of the phosphor stripes has a width, A, of about 0.27 mm and a pitch, B, of about 0.84 mm. In the normal viewing position of the embodiment, the phosphor stripes are separated from each other by a light-absorptive matrix material 23. The matrix lines typically have a width, C, of about 0.10 to 0.15 mm and a pitch, D, of about 0.28 mm. Alternatively, the screen can be a dot screen. A thin conductive layer 24, preferably of aluminum, overlies the screen 22 and provides a means for applying a uniform potential to the screen as well as for reflecting light, emitted from the phosphor elements, through the faceplate 18. The screen 22, the matrix 23 and the overlying aluminum layer 24 comprise a screen assembly.

With respect, again, to FIG. 1, a multi-apertured color selection electrode, or shadow mask, 25 is removably mounted, by conventional means, in predetermined spaced relation to the screen assembly. An electron gun 26, shown schematically by the dashed lines in FIG. 1, is centrally mounted within the neck 14, to generate and direct three electron beams 28 along convergent paths, through the apertures, or slots, in the mask 25, to the screen 22.

The tube 10 is designed to be used with an external magnetic deflection yoke, such as yoke 30, located in the region of the funnel-to-neck junction. When activated, the yoke 30 subjects the three beams 28 to magnetic fields which cause the beams to scan horizontally and vertically, in a rectangular raster, over the screen 22. The initial plane of deflection (at zero deflection) is shown by the line P—P in FIG. 1, at about the middle of the yoke 30. For simplicity, the actual curvatures of the deflection beam paths in the deflection zone are not shown.

The screen 22 is manufactured by an electrophotographic process that is shown in the block diagram of FIG. 3. Selected steps of the process are schematically represented in FIG. 4*a*–4*g*. The present process is similar to the process disclosed in U.S. Pat. No. 4,921,767, issued on May 1, 1990 to Datta et al., and in U.S. Pat. No. 5,028,501, issued on Jul. 2, 1991 to Ritt et al., both of which are incorporated by reference herein for the purpose of disclosure.

Figures 4A, 4B, 4C, 4D, 4E, 4F, 4G:
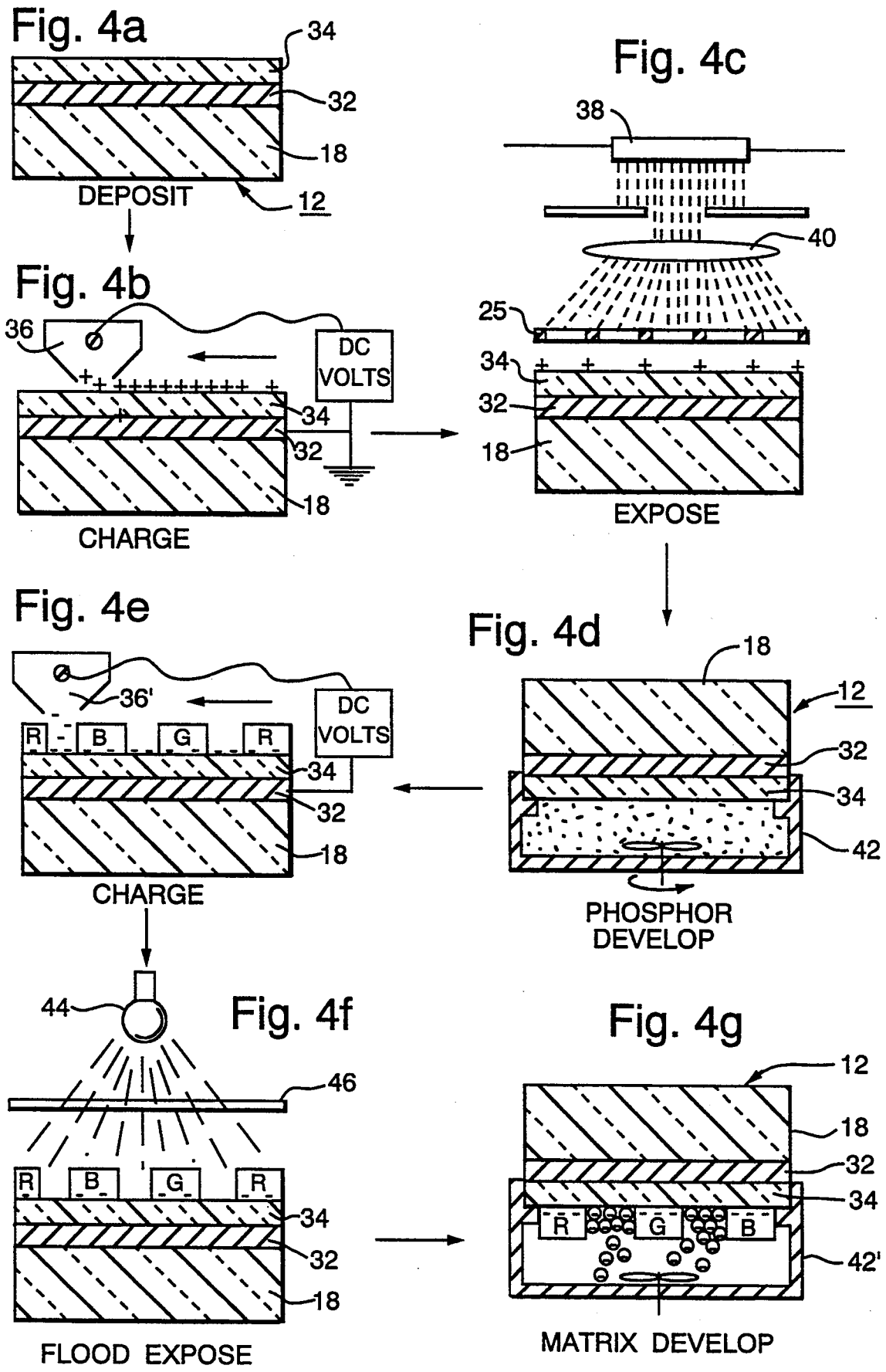
FIG. 4*a*–4*g* shows selected steps in the manufacturing of the screen assembly of FIG. 2.

In the present process, the panel 12 initially is washed with a caustic solution, rinsed in water, etched with buffered hydrofluoric acid and rinsed again with water, as is known in the art to prepare the panel. As shown in FIGS. 3 and 4*a*, the inner surface of the viewing faceplate 18 is then coated with an electrically conductive organic material which forms an organic conductive (OC) layer 32 that serves as an electrode for an overlying organic photoconductive (OPC) layer 34. Both the OC layer 32 and the OPC layer 34 are volatilizable at a temperature of about 425° C. As shown in FIG. 4*b*, the OPC layer 34 is charged, in a dark environment, to a positive potential of about 200 to 600 volts by a corona charging apparatus 36, of the type described in U.S. Pat. No. 5,083,959, issued on Jan. 28, 1992 to Datta et al., which also is incorporated by reference herein for disclosure purposes. The shadow mask 25 is inserted into the panel 12 and areas of the OPC layer 34, corresponding to the locations where green-emitting phosphor material will be deposited, are selectively discharged by exposure to actinic radiation, such as light from a xenon flash lamp or a mercury vapor lamp 38, shown in FIG. 4*c*, disposed within a first lighthouse (represented by lens 40). The lamp location within the first lighthouse approximates the convergence angle of the green phosphor-impinging electron beam. The shadow mask 25 is removed from the panel 12, and the panel is moved to a first developer 42, shown in FIG. 4*d*, containing suitably prepared dry-powdered particles of green-emitting phosphor screen structure material. The dry-powdered phosphor particles previously have been surface treated with a suitable charge controlling material, which encapsulates the phosphor particles and permits the establishment of a triboelectrically positive charge thereon. The positively-charged, green-emitting phosphor particles are expelled from the developer, repelled by the positively-charged areas of the OPC layer 34, and deposited onto the exposed, discharged areas of the OPC layer 34, in a process known as "reversal developing". Surface treating and triboelectric charging of the phosphor particles and the developing of the OPC layer 34 are described in U.S. Pat. No. 4,921,767.

The processes of charging, selectively discharging, and phosphor developing are repeated for the dry-powdered, blue- and red-emitting phosphor particles of screen structure material. The exposure to actinic radiation, to selectively discharge the positively-charged areas of the OPC layer 34, is made from locations within a second and then from a third lighthouse, to approximate the convergence angles of the blue phosphor- and red phosphor-impinging electron beams, respectively. The blue- and the red-emitting phosphor particles also are surface treated, to permit them to be triboelectrically charged to a positive potential. The blue- and red-emitting phosphor particles are expelled from second and third developers 42, repelled by the positively-charged areas of the previously deposited screen structure materials, and deposited onto the discharged areas of the OPC 34, to provide the blue- and red-emitting phosphor elements, respectively.

The matrix 23 is formed by charging the OPC layer 34 and the overlying phosphors to a negative potential of about 200 to 600 volts and preferably about 350 volts. As shown in FIG. 4*e*, a charger 36', similar to charger 36 but capable of generating a negative corona discharge, is used. The charging creates electrostatic "image forces" that are weaker in the areas with overlying phosphor particles and stronger where open areas of the OPC layer 34 are exposed between adjacent phosphor areas. As shown in FIG. 4*f*, the OPC layer 34 is flood illuminated using a mercury arc source 44 having a spectral distribution containing ultraviolet light with a wavelength at 365 nm. A UV pass visible blocking filter 46 such as a No. 5840 filter manufactured by Corning Glass Co., Corning, N.Y. may be positioned between the light source and the OPC layer 34 to filter out wavelengths longer than 400 nm. The ultraviolet radiation incident on the OPC layer 34 will discharge the open area from, an initial charge of about −350 volts, for example, to about −190 volts, after flood exposure; however, the phosphor materials, overlying the other portions of the OPC layer 34 will absorb the incident radiation while retaining a charge, thereby providing a shielding effect, so that the charge on the underlying OPC layer will not be diminished and the charge on the phosphors and the OPC layer will remain at about −350 volts. Because the novel process utilizes a flood exposure of the OPC layer 34, an additional precision lighthouse is not required, nor is it necessary to insert and then remove the shadow mask before and after the matrix exposure; although, the present process does not preclude using a mask to restrict the illumination to the open areas of the OPC layer 34. After the flood exposure, a large voltage contrast is developed between the discharged open areas and the underlying, phosphor-covered negatively charged areas of the OPC layer. The matrix material generally contains a black pigment, which is stable at tube processing temperatures, a polymer and a suitable charge control agent. The charge control agent facilitates providing a triboelectrically-negative charge on the matrix particles, as discussed in U.S. Pat. No. 4,921,767. Then, the panel 12 is placed on a matrix developer 42' from which finely divided particles of the negatively-charged light-absorptive matrix material are expelled, as shown in FIG. 4*g*. Since the image forces vary inversely with the square of the separation distance from the negatively-charged OPC layer 34, the negatively-charged matrix particles are preferentially driven toward the discharged open OPC areas, and strongly repelled by the undiminished negative charge on the phosphors and the underlying OPC layer 34. The matrix particles are thus directed into the less negatively charged gaps between the phosphor elements, but repelled from those areas already covered by the more negatively charged phosphor particles. Little contamination of the phosphors occurs. The novel matrix deposition process, with its high voltage contrast, thus provides a matrix of greater opacity, with fewer processing steps, than the prior electrophotographic matrix process described in the U.S. Pat. Nos. 4,921,767 and 5,028,501.

The screen structure materials, comprising the surface-treated black matrix material and the green-, blue- and red-emitting phosphor particles are electrostatically attached, or bonded, to the OPC layer 34. As described in U.S. Pat. No. 5,028,501, supra, the adherence of the screen structure materials can be increased by directly depositing thereon an electrostatically-charged, dry-powdered, filming resin from a fifth developer (not shown). The OC layer 32 is grounded during the deposition of the filming resin. A substantially uniform positive potential of about 200 to 400 volts is applied to the OPC layer 34 using a charging apparatus 36 similar to that shown in FIG. 4*b*, prior to the filming step, to provide an attractive potential and to assure a uniform deposition to the resin which, in this instance, is charged negatively. The developer may be a conventional electrostatic gun which charges the resin particles. The resin is an organic material with a low glass transition temperature/melt flow index of less than about 120° C. and with a pyrolization temperature of less than about 400° C. The resin is water insoluble, preferably has an irregular particle shape for better charge distribution, and has a particle size of less than about 50 microns. The preferred material is n-butyl methacrylate; however, other acrylic resins, methyl methacrylates and polyethylene waxes have been used successfully. About 2 grams of powdered filming resin is deposited onto the screen surface 22 of the faceplate 18. The faceplate is then heated to a temperature of between 100° to 120° C. for about 1 to 5 minutes using a suitable heat source, such as radiant heaters, to fuse the resin into a film (not shown). The resultant film is water insoluble and acts as a protective barrier, if a subsequent wet-filming step is required to provide additional film thickness or uniformity. Alternatively, the screen structure materials can be filmed using an aqueous emulsion, as is known in the art. An aqueous 2 to 4%, by weight, solution of boric acid or ammonium oxalate is oversprayed onto the film to form a ventilation-promoting coating (not shown). Then, the panel 12 is aluminized, as is known in the art, to form the aluminum layer 24, and baked at a temperature of about 425° C., for about 30 to 60 minutes, or until the volatilizable organic constituents of the screen assembly are removed.

What is claimed is:

1. In a method of electrophotographically manufacturing a luminescent screen assembly on an interior surface of a faceplate panel of a CRT, said panel having a conductive layer overcoated with a photoconductive layer and having a multiplicity of red-emitting, green-emitting and blue-emitting phosphor screen elements separated from each other by a light-absorbing matrix overlying previously open areas of said photoconductive layer, said phosphor screen elements being arranged in color groups, in a cyclic order, said phosphor screen elements being formed by sequentially exposing selected areas of said photoconductive layer to actinic radiation, to affect a charge thereon, and then, depositing triboelectrically-charged red-, green- and blue-emitting phosphor screen elements, respectively, onto said selected areas, the improvement wherein said matrix is formed by establishing a charge on said photoconductive layer, said charge initially being stronger in said open areas of said photoconductive layer than on the areas underlying said phosphor screen elements, discharging said open areas of said photoconductive layer between said phosphor screen elements by illuminating at least said open areas with actinic radiation, and then, developing said open areas by depositing thereon particles of matrix material having a suitable triboelectric charge.

2. The method as in claim 1, where said discharge step includes flood illumination of the entire photoconductive layer, whereby the charge on said open areas of said photoconductive layer is reduced while the charge on said photoconductive layer underlying said phosphor screen elements is substantially unaffected because of the shielding effect of said phosphor screen elements and a retained charge thereon.

3. The method as in claim 2, where said flood illumination comprises a wavelength of 365 nm with substantially no visible wavelength component.

4. The method as in claim 1, wherein said suitable triboelectric charge on said matrix particles is of the same polarity as the charge established on said photoconductive layer, so that said open areas are developed by reversal development.

5. The method as in claim 1, further including the steps of forming a film on said phosphor screen elements and said matrix material, aluminizing said film, and baking said faceplate panel to form said luminescent screen assembly.

6. In a method of electrophotographically manufacturing a luminescent screen assembly on an interior surface of a faceplate panel of a CRT, said panel having a conductive layer overcoated with a photoconductive layer and having a multiplicity of red-emitting, green-emitting and blue-emitting phosphor screen elements separated from each other by a light-absorbing matrix overlying previously open areas of said photoconductive layer, said phosphor screen elements being arranged in color groups, in a cyclic order, said phosphor screen elements being formed by sequentially exposing selected areas of said photoconductive layer to actinic radiation, to affect the charge thereon, and then depositing triboelectrically-charged red-, green- and blue-emitting phosphor screen elements, respectively, onto said selected areas, the improvement wherein said matrix is formed by establishing a charge on said photoconductive layer and on said phosphor screen elements, said charge initially being stronger in said open areas of said photoconductive layer than on the areas underlying said phosphor screen elements, discharging said open areas of said photoconductive layer between said phosphor screen elements by flood illuminating the entire photoconductive layer, whereby the charge on said open areas of said photoconductive layer is reduced while the charge on said phosphor screen elements and on said photoconductive layer underlying said phosphor screen elements is substantially unaffected because of the shielding effect of said phosphor screen elements, and then, reversal developing said open areas by depositing thereon particles of matrix material having a triboelectric charge thereon of the same polarity as that established on said phosphor screen elements and on said photoconductive layer.

7. The method as in claim 6, where said flood illumination comprises a wavelength of 365 nm with substantially no visible wavelength component.

8. The method as in claim 6, further including the steps of forming a film on said phosphor screen elements and said matrix material, aluminizing said film, and baking said faceplate panel to form said luminescent screen assembly.

* * * * *